US005605586A

United States Patent [19]

Bekki et al.

[11] Patent Number: 5,605,586

[45] **Date of Patent: *Feb. 25, 1997**

[54] ALUMINUM ALLOY SHEET SUITABLE FOR HIGH-SPEED FORMING AND PROCESS FOR MANUFACTURING THE SAME

[75] Inventors: Yoichiro Bekki; Minoru Hayashi; Ryo Syoji, all of Tokyo, Japan

[73] Assignees: The Furukawa Electric Co., Ltd., Tokyo; Kawasaki Steel Corporation, Hyogo, both of Japan

[ * ] Notice: The term of this patent shall not extend beyond the expiration date of Pat. No. 5,423,925.

[21] Appl. No.: 404,524

[22] Filed: Mar. 15, 1995

Related U.S. Application Data

[62] Division of Ser. No. 152,486, Nov. 12, 1993, abandoned.

[30] Foreign Application Priority Data

| | | | |
|---|---|---|---|
| Nov. 13, 1992 | [JP] | Japan | 4-328879 |
| Nov. 13, 1992 | [JP] | Japan | 4-328880 |
| Nov. 13, 1992 | [JP] | Japan | 4-328881 |

[51] Int. Cl.[6] ..... C22F 1/04

[52] U.S. Cl. ..... 148/549; 148/552; 148/689; 148/691; 148/692; 148/695; 148/696; 148/439; 148/440

[58] Field of Search ..... 148/549, 552, 148/689, 691, 692, 695, 696, 439, 440; 72/347, 700

[56] References Cited

U.S. PATENT DOCUMENTS

| | | | |
|---|---|---|---|
| 5,062,901 | 11/1991 | Tanaka et al. | 148/552 |
| 5,181,969 | 1/1993 | Komatsubara et al. | 148/552 |
| 5,423,925 | 6/1995 | Shoji et al. | 148/692 |

*Primary Examiner*—David A. Simmons
*Assistant Examiner*—Robert R. Koehler
*Attorney, Agent, or Firm*—Morrison Law Firm

[57] ABSTRACT

A method for manufacturing an aluminum alloy sheet suitable for high-speed forming includes subjecting the alloy to a homogenization treatment, hot rolling and cold rolling the homogenization treated alloy, thereby obtaining a cold-rolled sheet, and annealing the cold-rolled sheet. The aluminum alloy contains 4.0 to 10.0 wt. % of Mg, 0.2 wt. % of inevitable impurities of Fe and Si, 0.05 wt. % of other impurity elements, and the balance of Al. Another embodiment includes deep drawing the aluminum alloy sheet.

10 Claims, No Drawings

ALUMINUM ALLOY SHEET SUITABLE FOR HIGH-SPEED FORMING AND PROCESS FOR MANUFACTURING THE SAME

This is a divisional of application Ser. No. 08/152,486 filed on Nov. 12/93, now abandoned.

BACKGROUND OF THE INVENTION

1. Field of the Invention

The present invention relates to an aluminum alloy sheet for high-speed forming and a process for manufacturing the same, and more particularly to an aluminum alloy sheet having excellent strength and ductility, having a good external appearance after forming, and having excellent high-speed formability with an average strain rate of 0.01 $sec^{-1}$ and a process for obtaining the aluminum alloy sheet with high efficiency.

2. Description of the Related Art

Conventionally, a cold-rolled steel sheet has mainly been used as material for auto body sheets. However, there is an increasing demand for reduction in weight of an auto body, and using aluminum alloy sheets for material of auto outer panels.

In general, it is required that materials for auto body sheet have excellent press-formability and high strength. Aluminum alloy materials, which can meet these requirements, include JIS 5000-series Al—Mg—based alloys such as JIS 5052 alloy (Al—2.5 wt. % Mg—0.25 wt. % —0.25 wt. % Cr) and JIS 5182 alloy (Al—4.5 wt. % Mg—0.35 wt. % Mn).

Compared to a cold-rolled steel sheet, the JIS 5000-series aluminum alloy sheet has a lower ductility and is susceptible to cracking. In order to improve the ductility, various kinds of elements have been added or the amount of impurities has been reduced. However, at present, the ductility has not yet been enhanced.

SUMMARY OF THE INVENTION

The present invention aims at providing an aluminum alloy sheet having a substantially high formability, depending not on an apparent improvement in ductility, by positively making use of a difference in deformation force of a material for high-speed forming, and by improving deep drawability due to the texture of the material.

According to a first aspect of the invention, there is provided an aluminum alloy sheet suitable for high-speed forming at an average strain rate of 0.01 $sec^{-1}$ or more, produced by using an aluminum alloy containing 4.0 to 10.0 wt. % of Mg, inevitable impurities of Fe and Si whose content is limited to 0.2 wt. % or less, other impurity elements whose content is limited to 0.05 wt. % or less, and the balance of Al, wherein an m- value indicating strain rate sensitivity is −0.001 or less, an average ultimate tensile strength value in directions at 0°, 45° and 90° to a rolling direction, i.e. an average tensile strength value obtained by dividing, by 4, the sum of a ultimate tensile strength in a first direction at 0° to a rolling direction, double a ultimate tensile strength in a second direction at 45° to the rolling direction, and a tensile strength in a third direction at 90° to the rolling direction is 280 MPa or more, and at maximum difference in the ultimate tensile strength in the first, second and third directions is 5 MPa or more.

According to a second aspect of the invention, there is provided an aluminum alloy sheet suitable for high-speed forming at an average strain rate of 0.01 $sec^{1}$ or more, produced by using an aluminum alloy containing 4.0 to 10.0 wt. % of Mg, inevitable impurities of Fe and Si whose content is limited to 0.2 wt. % or less, other impurity elements whose content is limited to 0.05 wt. % or less, and the balance of Al wherein an m-value indicating strain rate sensitivity is −0.002 or less.

In the second aspect, it is desirable that an x-ray diffraction intensity of a (246) plane of a surface of the aluminum alloy sheet be 1.5 times an x-ray diffraction intensity of a (246) plane of a reference sample.

According to a third aspect of the invention, there is provided a process for manufacturing an aluminum alloy sheet suitable for high-speed forming, comprising the steps of: subjecting, to a homogenization treatment at 480° C. or above, an aluminum ingot containing 4.0 to 10.0 wt. % of Mg, inevitable impurities of Fe and Si whose content is limited to 0.2 wt. % or less, other impurity elements whose content is limited to 0.05 wt. % or less, and the balance of Al; subjecting the aluminum alloy ingot, which has undergone the homogenization treatment, to a hot rolling process and a cold rolling process, thereby obtaining a cold rolled sheet; and subjecting the cold rolled sheet to an annealing process in which the cold rolled sheet is heated at a temperature of 300° to 450° C .at a heating rate of 200° C./h or less and the cold rolled sheet is maintained for six hours or less at the temperature.

According to a fourth aspect of the invention, there is provided a process for manufacturing an aluminum alloy sheet suitable for high-speed forming, comprising the steps of: subjecting, to a homogenization treatment at 480° C. or above, an aluminum alloy ingot containing 4.0 to 10.0 wt. % of Mg, inevitable impurities of Fe and Si whose content is limited to 0.2 wt. % or less, other impurity elements whose content is limited to 0.05 wt. % or less, and the balance of Al, subjecting the aluminum alloy ingot, which has undergone the homogenization treatment, to a hot rolling process and a cold rolling process, thereby obtaining a cold rolled sheet; and subjecting the cold rolled sheet to an annealing process in which the cold rolled sheet is heated up to a temperature of 480° to 550° C. and maintained at the temperature for 60 seconds or less and then the cold rolled sheet is cooled down to 100° C. or less at a cooling rate of 10° C./h or more.

In the fourth aspect, it is desirable that the process further comprise a step of subjecting the cold rolled sheet to a final cold rolling process at a reduction of 10 to 50%, after the cold rolled sheet was subjected to an intermediate annealing process at a temperature of 300° to 550° C. in addition to the cold rolling process.

In the first to fourth aspects of the invention, the aluminum alloy may contain 0.1 to 0.5 wt. % of Cu.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

In the first and second aspects of the present invention, Mg is added in Al as a solid solution, thereby increasing the strength and enhancing the ductility by increasing the work hardenability. In addition, at the time of forming at high strain rate, a locking effect for dislocation decreases, and Mg functions to decrease the m-value representing the strain rate sensitivity (described hereunder). The Mg content in the aluminum alloy is limited to 4.0 to 10.0 wt. %. The reason is that if the Mg content is less than 4.0 wt. %, the above effect is low, and if it exceeds 10.0 wt. %, the anti-stress corrosion cracking properties (anti-SCC properties) deteriorate, and the hot processing properties deteriorate. As a result, the manufacture of aluminum alloy sheet becomes difficult.

When paint baking is effected on an aluminum alloy sheet, Cu functions to precipitate a GP zone, θ S-phase, etc. on the aluminum alloy. Thus, when the strength needs to be increased after painting, Cu is added. The Cu content in the aluminum alloy is limited to 0.1 to 0.5 wt. %. The reason is that if the Cu content is less than 0.5 wt. %, the increase in strength is low, and if it exceeds 0.5 wt. %, the corrosion resistance deteriorates.

Fe and Si are normally included in Al as impurities. However, Fe and Si tend to easily form an intermetallic compound, and the formed compound becomes an origin of crack at the time of forming, resulting in a decrease in ductility. The decrease in ductility becomes conspicuous if each of the Fe content and Si content in the aluminum alloy exceeds 0.2 wt. %. Accordingly, the Fe content and Si content in the aluminum alloy are limited to 0.2 wt. %, respectively.

Other impurity elements, Mn, Cr, Ti, Ni, Ga etc., serve to make finer crystal grains in the aluminum alloy or increase the matrix strength. However, if the content of each element increases, the ductility decreases. Thus, the content of each element is limited to 0.05 wt. % or less.

In the first aspect of the present invention, it is desirable that the crystal grain size in the metallography of the aluminum alloy sheet be 60 μm or less. The reason is that if the crystal grain size exceeds 60 μm, the locking effect of dislocation of solid-dissolved Mg atoms decreases and consequently sufficient strength is not obtained, and the effect of lowering the deformation force due to the increase in strain rate at the time of forming decreases, and consequently the m-value (described later) does not lower to −0.001 or less.

The aforementioned m-value will now be explained. The m-value is an index indicating the strain rate sensitivity. That is, the m-value is a value given by $m=\ln(P_{500}/P_{10})/\ln_{50}$, when a regular JIS-5 test piece is tensiled at rates of 10 mm/min and 500 mm/min, and stresses with 20% nominal strain are calculated and expressed as $P_{10}$ and $P_{500}$, respectively.

Normally, in the case of a cold-rolled steel sheet, m>0. In this case, the greater the strain rate, the greater the stress and strength. On the other hand, in the case of an aluminum alloy sheet of JIS 5000-series, m<0. In this case, the greater the strain rate, the lower the stress and strength. Accordingly, in the case of JIS 5000-series aluminum alloy sheet, the strength of the locally deformed and strain rate-increased portion decreases and it is broken immediately. Thus, generally, the aluminum alloy sheet is not considered to have good formability.

In general, in the press forming, there are two portions: one being loaded in contact with the punch, and the other flowing along the die. The portion loaded in contact with the punch is not deformed even in the process of high forming, except little sliding, and the strain rate of this portion is low. On the other hand, the portion flowing along the die has a strain rate proportional to the forming speed. Accordingly, the higher the speed of forming, the greater the difference in strain rate between the loaded portion and the flowing portion. This being the case, the inventors paid attention to the fact that the m-value of JIS 5000-series aluminum alloy sheet is a negative value, and they found that since the deformation force decreases in the flowing portion and the reduction of the deformation force decreases in the loaded portion as the strain rate increases in the case of forming using JIS 5000-series aluminum alloy sheet, the difference between the deformation force of the loaded portion and the deformation force of the flowing portion increases and the formability improves remarkably. In addition, it was found that the high-speed formability is excellent when the m-value has a relatively great negative value.

In the first aspect of the invention, in the case of forming with a high draw ratio, it is necessary that the m-value indicating the formability improvement be −0.001 or less and the average strain rate be 0.01 $sec^{-1}$ or above, in addition to conditions of the average value of ultimate tensile strength in three direction and a maximum strength difference in three directions (described later). Unless these conditions are satisfied, a sufficient formability is not obtained. In the second aspect of the invention, in the case of high-speed formation, it is necessary that the m-value be −0.002 or less and the average strain rate be 0.01 $sec^{-1}$ or above, and unless these conditions are satisfied, a sufficient formability is not obtained. The average strain rate is a value obtained by dividing the maximum strain (genuine strain) of a formed article by a time needed for formation.

In the first aspect of the invention, in the draw forming, a high ultimate tensile strength is necessary to flow a material beyond a ductility limit. It was found by experiments that in actual forming, in particular, in the case of forming with use of a low-viscosity lubricating oil, an average ultimate tensile strength value obtained by dividing, by 4, the sum of the ultimate tensile strength in a first direction at 0° to the rolling direction, double the ultimate tensile strength in a second direction at 45° to the rolling direction, and the ultimate tensile strength in a third direction at 90° to the rolling direction (hereinafter refereed to simply as "average ultimate tensile strength") needs to be 280 MPa or more. In addition, it was found that in the case of forming with a low draw ratio and a large draw height, it is important that the in-flow resistance of the flange is low and a texture having the maximum difference of 5 MPa or above in the three directions is effective. Unless these conditions are satisfied, cracking may occur in the case of forming with a high draw ratio.

In the second aspect of the invention, it is desirable that the crystal grain size in the metallography of the aluminum alloy sheet be 90 μm or less. The reason is that if the crystal grain size exceeds 90 μm, the dislocation locking effect of the solid-solution Mg atoms decreases and a sufficient strength is not obtained. In addition, the effect of decreasing deformation force obtained by increasing the strain rate in forming decreases, and consequently, the m-value does not lower to −0.002 or less.

In the second aspect of the invention, it is desirable that 90% or more of Mg contained in the aluminum alloy be kept in the solid-solution state. The reason is that if the amount of solid-dissolved Mg in the aluminum alloy is less than 90% of all Mg contained therein, the m-value does not lower to −0.002 or less. The Mg amount in the solid-solution state is found by obtaining a distribution of a Mg-based compound ($Mg_2Si$), calculating the Mg amount in the non-solid-solution state by image analysis, and finding the difference between the calculated Mg amount and the Mg content.

In the second aspect of the invention, the deep drawability of material is influenced by texture. If there is a large amount of a so-called R-directional component, in which (246) plane is parallel to the surface of the aluminum alloy sheet, the drawability is enhanced. Accordingly, excellent formability is obtained by meeting the above conditions of the m-value and average strain rate, as well as the condition that the x-ray diffraction intensity I (123) of (246) plane parallel to the surface of the aluminum alloy sheet, which is used in estimating the amount of the R-directional component, is 1.5 times the value I (123) of a reference sample. If this value is less than 1.5, the draw ratio is low and a sufficient formability may not be exhibited in forming with a large draw element. In this context, the reference sample means a sample obtained by solidifying particles of the same material.

In the third and fourth aspects of the invention, the homogenization treatment of ingot must be performed at high temperatures for a long time period, in order to add an intermetallic compound including Mg, Fe Si, etc. produced during forming into the matrix as a solid solution and to reduce the amount thereof. The temperature for homogenization treatment is set at 480° C. or above. If this temperature is less than 480° C., the compound cannot be fully changed to a solid solution within the actual working time.

There is no problem if the hot rolling process and cold rolling process are performed under normal conditions after the homogenization treatment. If necessary, an intermediate annealing process may be carried out during the cold rolling process. In the fourth aspect of the invention, the intermediate annealing process is performed during the cold rolling process at temperatures of 300° to 550° C. in order to completely recrystallize the metallography.

In the third and fourth aspects of the invention, it is desirable to perform, after the annealing process, leveling by means of a tension lever, surface washing, etching, application of lubricant oil, etc., if necessary.

In the third aspect of the invention, the rolled sheet is maintained at 300° to 450° C. in the annealing process with the final sheet thickness after the cold rolling process. The reason is that the metallography is not completely recrystallized if the maintenance temperature is less than 300° C., and if it is 450° C. or above, the crystal grain size does not decrease to 60° C. or less and a sufficient ultimate tensile strength is not obtained. Besides, the maintenance time in the annealing process is 6 hours or less. If the maintenance time exceeds 6 hours, no further improvement in characteristics is achieved, resulting only in eco. nomical disadvantage. Further, the temperature-increasing rate in the annealing process is 200° C./h or less. If the temperature-increasing rate exceeds 200° C./h, a maximum difference in three-directional ultimate tensile strength does not increase to 5 MPa or above.

In the fourth aspect of the invention, the rolled sheet is maintained at 480°to 550° C. in the annealing process with the final sheet thickness after the cold rolling process. This aims at sufficiently solid-dissolving the content elements and optimizing the crystal grain size. If the maintenance temperature is less than 480° C., the content elements cannot sufficiently solid-dissolved. If the maintenance temperature exceeds 550° C., grain coarsening occurs and the grain size does not reduce to 90 μ or less. It is possible that the sheet is melted, depending on the content of Mg. The maintenance time in the annealing process is 60 seconds or less. If the maintenance time exceeds 60 seconds, the grain size will coarsen. Furthermore, the temperature-decreasing rate in the annealing process is set at 10° C./sec or more and the temperature is lowered to 100° C. or below. This aims at preventing precipitation of solid-solution elements. If this condition is not met, the amount of solid-solution elements decreases owing to precipitation, the ductility lowers, and the m-value of −0.002 or less is not obtained.

In the fourth aspect of the invention, the reduction of the final cold rolling is set at 10 to 50%, in order to make the texture in the intermediate annealing process closer to the R texture. If the reduction is less than 10%, grain coarsening occurs and the grain size does not reduce to 90 μm or less. If the reduction exceeds 50%, nucleation occurs easily, and the texture is orientated at random. Consequently, the x-ray diffraction intensity I (123) of (246) plane (described later) does not increase to 1.5 times the x-ray diffraction intensity I (123) of the reference sample or more.

EXAMPLE 1

Aluminum alloys having compositions shown in Table 1 were melted and cost by a normal method. These aluminum alloys were combined with manufacturing methods shown in Table 2, as is shown in Table 3. Thus, 1 mm-thick aluminum alloy sheets were manufactured.

These aluminum alloy sheets were subjected to tensile tests, and the ultimate tensile strength, yield tensile strength and elongation of each alloy sheet were examined. In addition, the m-values were measured. A low-viscosity rust preventive oil was coated with a wrinkle pressing force of 3,000 kgf, and cylindrical draw forming was performed under the conditions: the blank=80 mmϕ, and the draw ratio=1.81. The formability at this time was evaluated in terms of the breaking limit height. These results are shown in Table 3.

TABLE 1

| COMPOSITION | Mg | Cu | Fe | Si | Mn | Cr | Ti | Zn | * | Al |
|---|---|---|---|---|---|---|---|---|---|---|
| ALLOY 1 OF PRESENT INVENTION | 5.8 | 0.21 | 0.04 | 0.05 | — | — | — | — | ≦0.02 | BALANCE |
| ALLOY 2 OF PRESENT INVENTION | 7.7 | — | 0.07 | 0.05 | — | — | — | — | ≦0.02 | BALANCE |
| ALLOY OF COMPARATIVE EXAMPLE | 3.8 | — | 0.11 | 0.14 | — | 0.09 | — | — | ≦0.02 | BALANCE |

Mark (*) indicates the content of each of other impurity elements (UNIT: wt.%)

TABLE 2

| | HOMOGENIZATION TREATMENT CONDITION | SHEET THICKNESS AFTER HOT ROLLING | FINAL SHEET THICKNESS | FINAL ANNEALING CONDITION | |
|---|---|---|---|---|---|
| | | | | TEMPERATURE RISE RATE | MAINTENANCE CONDITION |
| PROCESS 1 OF PRESENT INVENTION | 520° C. × 3 h | 5 mm | 1.0 mm | 50° C./h | 330° C. × 2 h |
| PROCESS 2 OF PRESENT INVENTION | 520° C. × 3 h | 5 mm | 1.0 mm | 50° C./h | 420° C. × 4 h |
| PROCESS 1 OF COMPARATIVE EXAMPLE | 520° C. × 3 h | 5 mm | 1.0 mm | 50° C./h | 490° C. × 4 h |
| PROCESS 2 OF COMPARATIVE EXAMPLE | 520° C. × 3 h | 5 mm | 1.0 mm | 20° C./sec | 520° C. × 20 sec |

TABLE 3

| | | EXAMPLES OF PRESENT INVENTION | | | COMPARATIVE EXAMPLE | | | *4 |
|---|---|---|---|---|---|---|---|---|
| | | ALLOY | | | | | | |
| | | ALLOY 1 OF PRESENT INVENTION | ALLOY 1 OF PRESENT INVENTION | ALLOY 2 OF PRESENT INVENTION | ALLOY 1 OF PRESENT INVENTION | ALLOY 1 OF PRESENT INVENTION | ALLOY OF COMPARATIVE EXAMPLE | ALLOY 1 OF PRESENT INVENTION |
| | | PROCESS | | | | | | |
| | | PROCESS 1 OF PRESENT INVENTION | PROCESS 2 OF PRESENT INVENTION | PROCESS 2 OF PRESENT INVENTION | PROCESS 1 OF COMPARATIVE EXAMPLE | PROCESS 2 OF COMPARATIVE EXAMPLE | PROCESS 2 OF PRESENT INVENTION | PROCESS 2 OF PRESENT INVENTION |
| ULTIMATE | 0° | 310 | 302 | 352 | 279 | 288 | 277 | 302 |
| TENSILE | 45° | 299 | 293 | 341 | 272 | 285 | 269 | 293 |
| STRENGTH (MPa) | 90° | 303 | 299 | 347 | 277 | 286 | 272 | 299 |
| YIELD | 0° | 142 | 137 | 157 | 122 | 122 | 108 | 137 |
| TENSILE | 45° | 135 | 131 | 147 | 118 | 118 | 103 | 131 |
| STRENGTH (MPa) | 90° | 140 | 134 | 154 | 119 | 119 | 109 | 134 |
| ELONGATION | 0° | 31.6 | 32.9 | 37.6 | 34.5 | 34.5 | 28.9 | 32.9 |
| (%) | 45° | 34.1 | 34.2 | 39.1 | 35.9 | 35.9 | 30.2 | 34.2 |
| | 90° | 33.3 | 33.0 | 41.2 | 35.6 | 35.6 | 31.6 | 33.0 |
| AVERAGE STRENGTH *1 | | 303 | 297 | 345 | 275 | 286 | 272 | 297 |
| MAXIMUM STRENGTH DIFFERENCE *2 | | 11 | 9 | 11 | 7 | 3 | 8 | 9 |
| DIFFERENCE m-VALUE *3 | | −0.002 | −0.001 | −0.002 | 0.0004 | −0.002 | 0.0003 | −0.001 |
| GRAIN SIZE (μm) | | 29 | 42 | 38 | 74 | 55 | 46 | 42 |
| AVERAGE STRAIN RATE | | 0.09 | 0.11 | 0.17 | 0.10 | 0.09 | 0.07 | 0.001 |
| BREAKING LIMIT HEIGHT (mm) | | 28.6 | 27.8 | 29.2 | 23.9 | 24.6 | 22.2 | 24.8 |

*1: The average strength is an average ultimate tensile strength value obtained by dividing, by 4, the sum of a ultimate tensile strength in a first direction at 0° to a rolling direction, double a ultimate tensile strength in a second direction at 45° to the rolling direction and a ultimate tensile strength in a third direction at 90° to the rolling direction.
*2: The maximum strength difference is a maximum difference between three-directional ultimate tensile strengths.
*3: The m-value is an average value of three-directional m-values.
*4: The average strain rate is less than 0.01.

As is clear from Table 3, in the forming tests, the breaking limit height of any of the aluminum alloy sheets of the present invention is greater than 25 mm or a conventional level, and the formability is excellent. By contrast, as regards any of the aluminum alloy sheets of the comparative examples, the breaking limit height is not greater than 25 mm and the formability is not good. In the case of the aluminum alloy sheet of the present invention, if a strain rate is less than 0.01 $sec^{-1}$ , the breaking limit height is not greater than 25 mm and the formability is not good.

Example 2

Aluminum alloys having compositions shown in Table 1 were melted and cost by a normal method. These aluminum alloys were combined with manufacturing methods shown in Table 4, as is shown in Table 5. Thus, 1 mm-thick aluminum alloy sheets were manufactured.

These aluminum alloy sheets were subjected to tensile tests, and the ultimate tensile strength, yield tensile strength and elongation of each alloy sheet were examined. In addition, the m-values were measured. A low-viscosity rust preventive oil was coated with a wrinkle pressing force of 3,000 kgf, and cylindrical draw forming was performed under the conditions: the blank=88 mmϕ, and the draw ratio=2.0. The formability at this time was evaluated in terms of the breaking limit height. These results are shown in Table 5.

TABLE 4

| | HOMOGENIZATION TREATMENT CONDITION | SHEET THICKNESS AFTER HOT ROLLING | FINAL SHEET THICKNESS | FINAL ANNEALING CONDITION | |
|---|---|---|---|---|---|
| | | | | MAINTENANCE CONDITION | TEMPERATURE DECREASE RATE |
| PROCESS 3 OF PRESENT INVENTION | 520° C. × 3 h | 5 mm | 1.0 mm | 490° C. × 10 sec | 20° C./sec |
| PROCESS 4 OF PRESENT INVENTION | 520° C. × 3 h | 5 mm | 1.0 mm | 540° C. × 10 sec | 20° C./sec |
| PROCESS 3 OF COMPARATIVE EXAMPLE | 520° C. × 3 h | 5 mm | 1.0 mm | 570° C. × 30 sec | 20° C./sec |
| PROCESS 4 OF COMPARATIVE EXAMPLE | 450° C. × 1 h | 5 mm | 1.0 mm | 440° C. × 10 sec | 20° C./sec |

TABLE 5

| | EXAMPLES OF PRESENT INVENTION | | | COMPARATIVE EXAMPLE | | | *2 |
|---|---|---|---|---|---|---|---|
| | ALLOY | | | | | | |
| | ALLOY 1 OF PRESENT INVENTION | ALLOY 1 OF PRESENT INVENTION | ALLOY 2 OF PRESENT INVENTION | ALLOY 1 OF PRESENT INVENTION | ALLOY 1 OF PRESENT INVENTION | ALLOY OF COMPARATIVE EXAMPLE | ALLOY 1 OF PRESENT INVENTION |
| | PROCESS | | | | | | |
| | PROCESS 3 OF PRESENT INVENTION | PROCESS 4 OF PRESENT INVENTION | PROCESS 4 OF PRESENT INVENTION | PROCESS 3 OF COMPARATIVE EXAMPLE | PROCESS 4 OF COMPARATIVE EXAMPLE | PROCESS 4 OF PRESENT INVENTION | PROCESS 4 OF PRESENT INVENTION |
| ULTIMATE TENSILE STRENGTH (MPa) | 310 | 305 | 342 | 301 | 325 | 273 | 305 |
| YIELD TENSILE STRENGTH (MPa) | 142 | 132 | 154 | 117 | 144 | 102 | 132 |
| ELONGATION (%) | 34.2 | 35.3 | 39.4 | 36.5 | 33.5 | 29.0 | 35.3 |
| m-VALUE *1 | −0.004 | −0.003 | −0.006 | −0.001 | −0.001 | −0.001 | −0.003 |
| GRAIN SIZE (μm) | 35 | 49 | 60 | 110 | 27 | 41 | 49 |
| Mg SOLID SOLUTION RATIO (%) | 95 | 97 | 93 | 98 | 88 | 98 | 97 |
| AVERAGE STRAIN RATE | 0.07 | 0.09 | 0.15 | 0.08 | 0.07 | 0.05 | 0.002 |
| BREAKING LIMIT HEIGHT (mm) | 21.3 | 22.2 | 23.5 | 19.9 | 19.2 | 18.2 | 19.8 |

*1: The m-value is an average value of three-directional m-values.
*2: The average strain rate is less than 0.01.

As is clear from Table 5, in the forming tests, the breaking limit height of any of the aluminum alloy sheets of the present invention is greater than 20 mm or a conventional level, and the formability is excellent. By contrast, as regards any of the aluminum alloy sheets of the comparative examples, the breaking limit height is not greater than 20 mm and the formability is not good. In the case of the aluminum alloy sheet of the present invention, if a strain rate is less than 0.01 $sec^1$, the breaking limit height is not greater than 20 mm and the formability is not good.

Example 3

Aluminum alloys having compositions shown in Table 1 were melted and cost by a normal method. These aluminum alloys were combined with manufacturing methods shown in Table 6, as is shown in Table 7. Thus, 1 mm-thick aluminum alloy sheets were manufactured.

These aluminum alloy sheets were subjected to tensile tests, and the ultimate tensile strength, yield tensile strength and elongation of each alloy sheet were examined. In addition, the m-values were measured. A low-viscosity rust preventive oil was coated with a wrinkle pressing force of 2,000 kgf, and cylindrical draw forming was performed under the conditions: the blank=80 mmϕ, and the draw ratio=1.81. The formability at this time was evaluated in terms of the breaking limit height. These results are shown in Table 7.

TABLE 6

| | HOMOGENIZATION | SHEET THICK- | INTERMEDIATE ANNEALING | |
|---|---|---|---|---|
| | TREATMENT CONDITION | NESS AFTER HOT ROLLING | SHEET THICKNESS | CONDITION |
| PROCESS 5 OF PRESENT INVENTION | 520° C. × 3 h | 5 mm | 1.8 mm | 360° C. × 2 h |
| PROCESS 6 OF PRESENT INVENTION | 520° C. × 3 h | 5 mm | 1.3 mm | 360° C. × 2 h |
| PROCESS 5 OF COMPARATIVE EXAMPLE | 520° C. × 3 h | 5 mm | 1.06 mm | 360° C. × 2 h |
| PROCESS 6 OF COMPARATIVE EXAMPLE | 520° C. × 3 h | 5 mm | Non | |

| | FINAL | FINAL ANNEALING CONDITION | |
|---|---|---|---|
| | SHEET THICKNESS (mm) | MAINTENANCE CONDITION | TEMPERATURE DECREASE RATE |
| PROCESS 5 OF PRESENT INVENTION | 1.0 mm | 540° C. × 10 sec | 20° C./sec |
| PROCESS 6 OF PRESENT INVENTION | 1.0 mm | 500° C. × 10 sec | 20° C./sec |
| PROCESS 5 OF COMPARATIVE EXAMPLE | 1.0 mm | 540° C. × 30 sec | 20° C./sec |
| PROCESS 6 OF COMPARATIVE EXAMPLE | 1.0 mm | 540° C. × 10 sec | 20° C./sec |

TABLE 7

| | EXAMPLES OF PRESENT INVENTION | | | COMPARATIVE EXAMPLE | | | *2 |
|---|---|---|---|---|---|---|---|
| | ALLOY | | | | | | |
| | ALLOY 1 OF PRESENT INVENTION | ALLOY 1 OF PRESENT INVENTION | ALLOY 2 OF PRESENT INVENTION | ALLOY 1 OF PRESENT INVENTION | ALLOY 1 OF PRESENT INVENTION | ALLOY OF COMPARATIVE EXAMPLE | ALLOY 1 OF PRESENT INVENTION |
| | PROCESS | | | | | | |
| | PROCESS 5 OF PRESENT INVENTION | PROCESS 6 OF PRESENT INVENTION | PROCESS 6 OF PRESENT INVENTION | PROCESS 5 OF COMPARATIVE EXAMPLE | PROCESS 6 OF COMPARATIVE EXAMPLE | PROCESS 6 OF PRESENT INVENTION | PROCESS 6 OF PRESENT INVENTION |
| ULTIMATE TENSILE STRENGTH (MPa) | 300 | 312 | 349 | 298 | 310 | 277 | 312 |
| YIELD TENSILE STRENGTH (MPa) | 135 | 145 | 159 | 112 | 138 | 104 | 145 |
| ELONGATION (%) | 34.0 | 35.0 | 38.6 | 36.0 | 36.2 | 28.9 | 35.0 |
| m-VALUE *1 | −0.005 | −0.004 | −0.006 | −0.001 | −0.004 | −0.001 | −0.004 |

| | EXAMPLES OF PRESENT INVENTION | | | COMPARATIVE EXAMPLE | | | *2 |
|---|---|---|---|---|---|---|---|
| | ALLOY | | | | | | |
| | ALLOY 1 OF PRESENT INVENTION | ALLOY 1 OF PRESENT INVENTION | ALLOY 2 OF PRESENT INVENTION | ALLOY 1 OF PRESENT INVENTION | ALLOY 1 OF PRESENT INVENTION | ALLOY OF COMPARATIVE EXAMPLE | ALLOY 1 OF PRESENT INVENTION |
| | PROCESS | | | | | | |
| | PROCESS 3 OF PRESENT INVENTION | PROCESS 4 OF PRESENT INVENTION | PROCESS 4 OF PRESENT INVENTION | PROCESS 3 OF COMPARATIVE EXAMPLE | PROCESS 4 OF COMPARATIVE EXAMPLE | PROCESS 4 OF PRESENT INVENTION | PROCESS 4 OF PRESENT INVENTION |
| GRAIN SIZE (μm) | 48 | 39 | 35 | 125 | 42 | 41 | 39 |
| Mg SOLID SOLUTION RATIO (%) | 97 | 94 | 93 | 97 | 96 | 98 | 94 |
| I (1 2 3) STRENGTH RATIO | 2.2 | 1.9 | 1.8 | 1.8 | 1.4 | 1.7 | 1.9 |
| AVERAGE STRAIN RATE | 0.09 | 0.10 | 0.17 | 0.09 | 0.10 | 0.06 | 0.003 |
| BREAKING LIMIT HEIGHT (mm) | 26.4 | 27.0 | 28.5 | 23.9 | 24.8 | 21.7 | 24.0 |

*1: The m-value is an average value of three-directional m-values.
*2: The average strain rate is less than 0.01.

As is clear from Table 7, in the forming tests, the breaking limit height of any of the aluminum alloy sheets of the present invention is greater than 25 mm or a conventional level, and the formability is excellent. By contrast, as regards any of the aluminum alloy sheets of the comparative examples, the breaking limit height is not greater than 25 mm and the formability is not good. In the case of the aluminum alloy sheet of the present invention, if a strain rate is less than 0.01 $sec^1$, the breaking limit height is not greater than 25 mm and the formability is not good.

As has been described above, the aluminum alloy sheet of the present invention has excellent formability in high-speed forming, and it is suitable, in particular to mechanical press and high-speed hydraulic press which are widely employed in actual work. This aluminum alloy sheet is optimal as forming material for auto body sheets, pressure-proof containers, packing containers, etc., and it has remarkable industrial advantages.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A process for manufacturing an aluminum alloy sheet suitable for high-speed forming, comprising the steps of:

subjecting, to a homogenization treatment at 480° C. or above, an aluminum alloy ingot containing 4.0 to 10.0 wt. % of Mg, inevitable impurities of Fe and Si whose content is limited to 0.2 wt. % or less, other impurity elements whose content is limited to 0.05 wt. % or less, and the balance of Al;

subjecting the aluminum alloy ingot, which has undergone the homogenization treatment, to a hot rolling process and a cold rolling process, thereby obtaining a cold rolled sheet; and subjecting the cold rolled sheet to an annealing process in which the cold rolled sheet is heated at a temperature of 300° to 450° C. at a heating rate of 200° C./h or less and said cold rolled sheet is maintained for six hours or less at said temperature.

2. The process according to claim 1, wherein said aluminum alloy contains 0.1 to 0.5 wt. % of Cu.

3. A process for manufacturing an aluminum alloy sheet suitable for high-speed forming, comprising the steps of:

subjecting, to a homogenization treatment at 480° C. or above, an aluminum alloy ingot containing 4.0 to 10.0 wt. % of Mg, inevitable impurities of Fe and Si whose content is limited to 0.2 wt. % or less, other impurity elements whose content is limited to 0.05 wt. % or less, and the balance of Al;

subjecting the aluminum alloy ingot, which has undergone the homogenization treatment, to a hot rolling process and a cold rolling process, thereby obtaining a cold rolled sheet; and subjecting the cold rolled sheet to an annealling process in which the cold rolled sheet is heated up to a temperature of 480° to 550° C. and maintained at said temperature for 60 seconds or less and then the rolled sheet is cooled down to 100° C. or less at a cooling rate of 10° C./h or more.

4. The process according to claim 3, further comprising a step of subjecting said cold rolled sheet to a final cold rolling process at a reduction of 10 to 50%, after said rolled sheet was subjected to an intermediate annealing process at a temperature of 300° to 550° C.

5. The process according to claim 3, wherein said aluminum alloy contains 0.1 to 0.5 wt. % of Cu.

6. A method for forming an aluminum alloy sheet, comprising the steps of:

preparing an aluminum alloy sheet made of an aluminum alloy containing from about 4.0 to 10.0% by weight of Mg, inevitable impurities of Fe and Si whose content is limited to about 0.2% by weight or less, and other impurity elements whose content is limited to about 0.05% by weight or less, and the balance being Al;

wherein an m-value indicating strain rate sensitivity is −0.001 or less, an average ultimate tensile strength value obtained by dividing, by 4, the sum of ultimate tensile strength in a first direction at zero degrees to a rolling direction, double an ultimate tensile strength in a second direction at 45 degrees to the rolling direction, and an ultimate tensile strength in a third direction at 90 degrees to the rolling direction is at least 280 MPa, and a maximum difference in the ultimate tensile direction in said first, second and third directions is at least 5 MPa;

applying a high-speed deep drawing to said aluminum alloy sheet at an average strain rate of at least 0.01 $sec^1$.

7. The method according to claim 6, wherein the step of preparing includes said aluminum alloy containing from about 0.1 to 0.5% by weight of Cu.

8. A method for forming an aluminum alloy sheet, comprising the steps of:

preparing an aluminum alloy sheet made of an aluminum alloy containing from about 4.0 to 10.0% by weight of Mg, inevitable impurities of Fe and Si whose content is limited to about 0.2% by weight or less, and other impurity elements whose content is limited to about 0.05 % by weight or less, and the balance being Al;

wherein an m-value indicating strain rate sensitivity is −0.002 or less; and, applying a high-speed deep drawing to said aluminum alloy sheet at an average strain rate of at least 0.01 $sec^{i-}$.

9. The method according to claim 8, wherein the step of preparing includes said aluminum alloy having an x-ray diffraction intensity of a plane of a surface of said aluminum alloy sheet that is 1.5 times an xray diffraction intensity of a plane of a references sample.

10. The method according to claim 8, wherein the step of preparing includes said aluminum alloy containing from about 0.1 to 0.5% by weight of Cu.

* * * * *